United States Patent [19]

Biek

[11] Patent Number: 4,462,282

[45] Date of Patent: Jul. 31, 1984

[54] POWER TOOL WITH TORQUE REACTION BAR

[75] Inventor: Paul A. Biek, Houston, Tex.

[73] Assignee: Dresser Industries, Inc., Dallas, Tex.

[21] Appl. No.: 441,691

[22] Filed: Nov. 15, 1982

[51] Int. Cl.[3] ..... B25B 17/00

[52] U.S. Cl. ..... 81/57.11; 81/57.31; 173/12; 408/124

[58] Field of Search ..... 81/57, 57.11, 57.12, 81/57.13, 57.28, 57.29, 57.30, 57.31; 408/124; 173/12

[56] References Cited

U.S. PATENT DOCUMENTS 4,155,278 5/1979 Estok ..... 81/57.11

*Primary Examiner*—Frederick R. Schmidt
*Assistant Examiner*—J. T. Zatarga
*Attorney, Agent, or Firm*—Roy L. Van Winkle

[57] ABSTRACT

The improved power tool includes a housing having a motor located in the housing and a rotatable tool drive shaft projecting from the housing. A torque reaction bar is attached to the housing and is engageable with a stationary object to prevent rotation of the housing relative to a threaded fastener or the like being operated upon. A tool handle rotatably encircles the housing permitting the positioning of the handle in any desired position relative to the housing and, due to the swivel or pivoting relationship, preventing the imposition of torque on the handle.

6 Claims, 2 Drawing Figures

POWER TOOL WITH TORQUE REACTION BAR

BACKGROUND OF THE INVENTION

This invention relates generally to an improved power tool that includes a torque reaction bar. More particularly, but not by way of limitation, this invention relates to an improved power tool that includes a torque reaction bar and has a handle that can be positioned as desired relative to the tool housing.

In the use of power tools which have a rotating output shaft for driving nuts, threaded fasteners, drill bits, etc., reaction torque occurs which is particularly high upon the tightening of the nut or fastener, or in the event that the drill bit should stick. When such tools are used in mass production with many repetitive operations being performed, even a slight amount of reaction torque makes it difficult for the operator to be efficient and accurate. Therefore, it is desirable to remove all the reaction torque from the operator of the tool whenever possible.

In the past, power tools have been provided with reaction bars that are either manually held by the operator or placed in engagement with some convenient fixed object to prevent rotation of the housing due to the reaction torque. Such measures have succeeded in avoiding the imposition of extremely high torque loads on the operator. With such tools, however, it has been found that the tool handle, which generally contains the trigger, valve, etc. for operating the tool, may not be conveniently located when the reaction bar is engaged with the stationary object. Thus, another element of operator fatigue may be introduced when the tool is used on different types of assemblies.

To counter this problem, prior art devices such as, for example the tool described in U.S. Pat. No. 4,155,278 issued May 22, 1979 to Eugene M. Estok were constructed. That tool employes a swivel located between sections of the tool housing. One of the housing sections encompasses the speed reduction unit of the power tool, and the other encompasses the motor for driving the speed reducer. The use of the swivel has permitted the handle to be positioned as desired relative to the work piece, and thus substantially eliminated that element of operator fatigue.

However, the reaction torque is not entirely eliminated, although a large portion of it is absorbed by the torque reaction bar and prevented from reaching the operator due to the swivel. As noted in the patent, a portion of the reaction torque is still transmitted through the motor to the handle despite the swivel connection and, thus, is imposed on the operator. Again, it must be remembered that the repetitive nature of assembly operations is such that even the imposition of slight amount of torque may seriously fatigue the operator and interfer with his efficiency and accuracy.

SUMMARY OF THE INVENTION

It is therefore an object of this invention to provide an improved power tool wherein reaction torque will is eliminated from imposition on the operator of the tool.

This invention then provides an improved power tool for performing an operation or a work piece wherein the tool comprises a hollow housing; a motor located in the housing; and a rotatable tool drive shaft that projects from the housing. A torque reaction member is attached to the housing for preventing rotation of the housing relative to the work piece while an operation is being performed on the work piece. The tool handle includes a bore for rotatably or pivotally receiving the hollow housing whereby the handle can be positioned as desired relative to the housing and whereby torque is not imposed on the handle by the housing.

BRIEF DESCRIPTION OF THE DRAWING

The foregoing and additional objects and advantages of the invention will become more apparent as the following detailed description is read in conjunction with the accompanying drawing, wherein.

DETAILED DESCRIPTION OF THE PREFERRED EMBODIMENT

Figure 1:
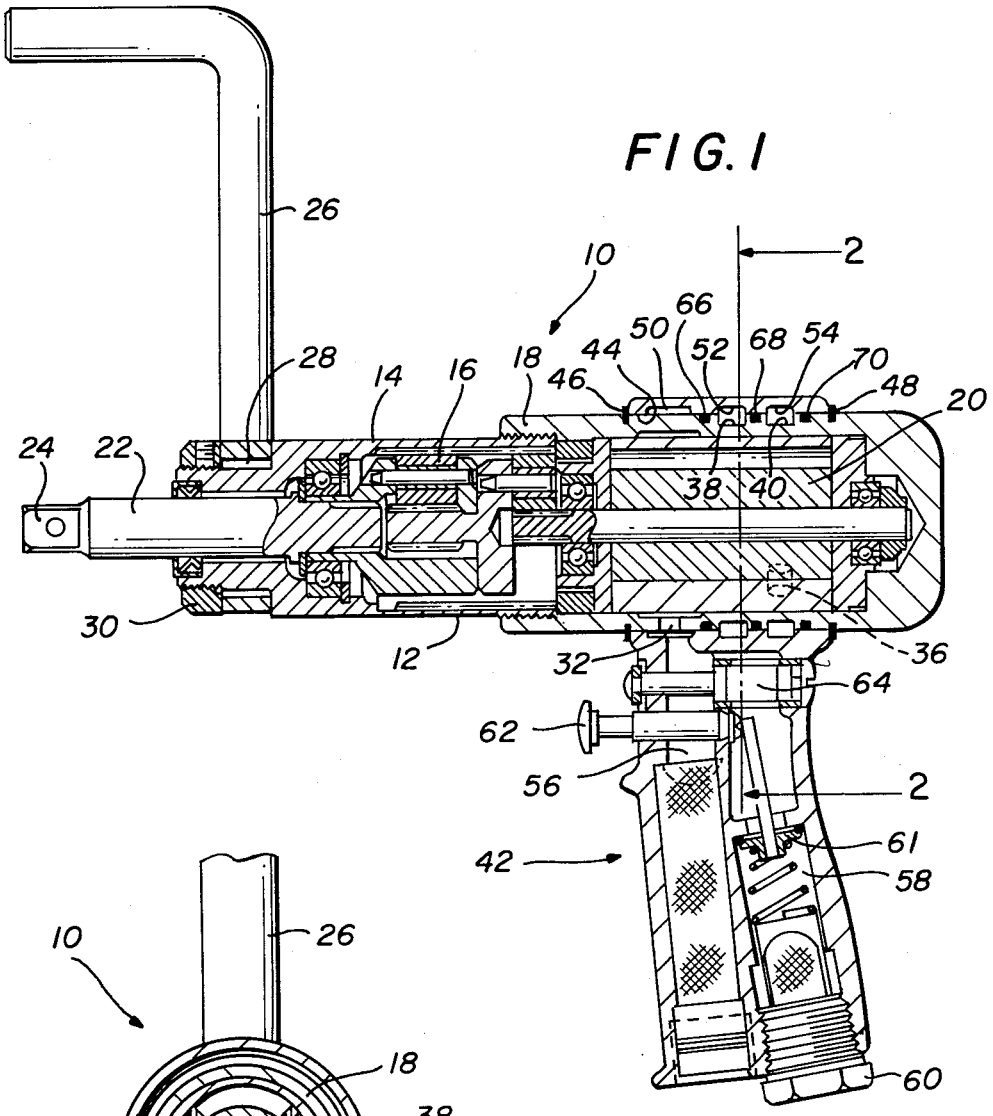
FIG. 1 is a cross-sectional view of a power tool contructed in accordance with the invention.

Referring to the drawing and to FIG. 1 in particular, shown therein and generally designated by the reference character 10, is a power tool, usually referred to as a nut runner. The nut runner 10 includes a hollow housing 12. The housing 12 is comprised of a front section 14 containing a gear reduction assembly 16 and a rear housing section 18 that contains a pneumatically driven motor 20. Protruding from the front end of the housing 12 is a rotatable tool drive shaft 22. The tool drive shaft 22 is adapted at 24 for connection with an appropriate tool, such as a socket or the like, which is not shown.

Connected to the housing section 14 is a torque reaction bar 26. Rotation of the torque reaction bar 26 relative to the housing section 14 is prevented by matching splines 28 which are located on the inside of the reaction bar 26 and the exterior of the housing section 14. A collar 30 is attached to the housing section 14 forward of the reaction bar 26 retaining the splines 28 in engagement and preventing the reaction bar 26 from being dislodged from the tool 10.

Figure 2:
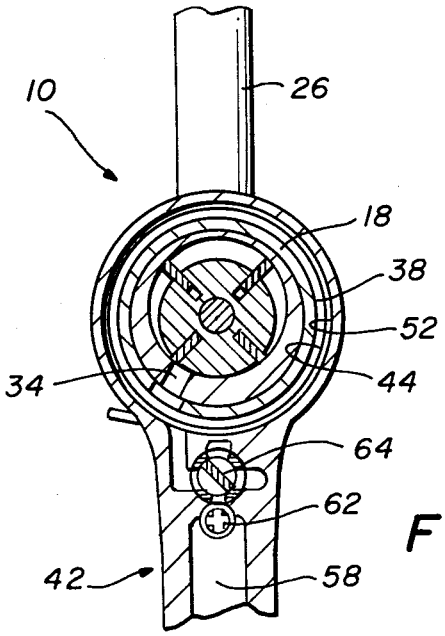
FIG. 2 is a transverse, cross-sectional view taken generally along the line 2—2 of FIG. 1.

The rear housing section 18 of the housing 12 includes an exhaust port 32, a forward inlet port 34 (see FIG. 2); and a reverse inlet port 36 (shown in dash lines in FIG. 1). On the exterior of the housing section 18 there is provided an annular groove 38 that is in fluid communication with the forward inlet port 34 in the housing section 18. Similarly, there is provided an annular groove 40 in the exterior of the housing section 18 that is in fluid communication with the reverse inlet port 36.

The tool 10 includes a handle assembly 42 that is provided at its upper end with a bore 44 sized to rotatably receive the housing section 18. As illustrated in FIG. 1, lock rings 46 and 48 are carried by the housing section 18 to retain the handle assembly 42 on the housing section 18. Manifestly, the lock rings 46 and 48 could be replaced by other appropriate fasteners or abutments as desired so long as the handle assembly 42 is pivoted on the housing section 18.

The handle assembly 42 is provided, in the bore 44, with an annular exhaust groove 50, an annular forward inlet groove 52 and an annular reverse inlet groove 54. It will be noted that the exhaust groove 50 is in fluid communication with the exhaust port 32 in the housing section 18. Similarly, the forward inlet groove 52 is in alignment with the groove 38 in the housing section 18 and with the forward inlet port 34. The reverse inlet groove 54 in the handle 42 is in alignment with the groove 40 in the housing section 18 and in fluid communication with the reverse inlet port 36. Due to the annular configuration of the various grooves and the fact that they are retained in alignment, the relative position of the handle assembly 42 on the housing section 18 is immaterial since appropriate fluid flow to the motor 20 can occur.

The handle assembly 42 does include an exhaust passageway 56 that is in fluid communication with the exhaust port 32. An inlet passageway 58 in the handle assembly 42 includes a fitting 60 for connecting the tool 10 with a source of fluid under pressure (not shown) for driving the motor 20. In the inlet passageway 58 is a control valve 60 actuated by trigger 62 to permit or prevent flow through the inlet passageway 58 to a selector valve 64. The selector valve 64 (or reversing valve) is arranged so that the fluid under pressure may pass through the passageway 58 into the appropriate forward inlet groove 52 or the reverse inlet groove 54 as desired by the operator of the tool 10. The purpose of the valve 64 is to cause the tool 10 to operate either in the forward direction for tightening a nut, in the case of a nut runner, or for unscrewing a nut as desired.

Seals 66, 68 and 70 are disposed between the housing section 18 and the handle assembly 42 in the bore 44. In the illustrated embodiment the seals are of the O-ring type. The seal 66 is provided to isolate the fluid in the exhaust groove 50 from fluid in the forward inlet groove 52. The seal 68 prevents flow between the forward inlet groove 52 and the reverse inlet groove 52. The seal 70 prevents flow from the reverse inlet groove 52 to the atmosphere. Thus, each of the fluid passageways is appropriately isolated from the other or from the atmosphere as necessary.

In operation, the appropriate tool, such as a socket or bit, is attached to the tool drive shaft 22 with the source of the fluid under pressure attached to the fitting 60 and the tool 10 placed on, for example, a fastener. The torque reaction bar 26 is engaged with some stationary object that is convenient so that the torque imposed is absorbed thereby. Any reaction torque transmitted through the gear reduction 16 or the motor 20 is absorbed thereby or in the housing 14. It should be obvious that no torque can be transmitted into the handle assembly 42 due to the pivotal or rotatable interconnection between the housing 12 and the handle assembly 42. Thus, the operator can conveniently position the handle assembly 42 as desired for the most comfortable operating position. Further, no torque is transmitted into the handle assembly 42 and thus a source of fatigue is eliminated.

Should it be desired to reverse the tool 10, the selector valve 64 is positioned to admit fluid into the reverse inlet port 40 driving the motor 20 in the opposite direction and consequently driving the tool drive shaft 22 in the opposite direction. If the torque reaction bar 26 is not engaging a fixed object at that time, it may swing thereagainst with the housing 12 rotating until the reaction bar 26 stops. It will be obvious that the rotation of the housing 14 will not be transmitted to the operator since the housing 14 simply rotates or swivels within the bore 44 of the handle assembly 42 permitting the operator to retain his comfortable grip on the handle assembly 42.

Thus, from the foregoing detailed description it can be seen that the additional feature of positioning the handle in a rotatable manner on the entire housing provides an improvement to such tools in that no torque can be transmitted to the operator of the tool while permitting the positioning of the handle to any position desired.

Having described but a single embodiment of the invention, it will be understood that many changes and modifications could be made thereto without departing from the spirit and scope of the invention.

The embodiments of the invention in which an exclusive property or privilege is claimed are defined as follows:

1. An improved power tool for performing an operation on a work piece, said tool comprising:

a hollow housing;

motor means located in said housing and including a rotatable tool drive shaft projecting from said housing;

torque reaction means attached to said housing for preventing rotation of said housing relative to said work piece while an operation is being performed on said work piece; and handle means including a bore rotatably receiving said hollow housing, whereby said handle means can be positioned as desired relative to said housing and whereby torque cannot be imposed on said handle means by said housing.

2. The power tool of claim 1 wherein:

said housing having inlet port means and an exhaust port extending therethrough for providing fluid communication with said motor means; and said handle means includes an annular inlet groove therein adjacent to said bore in communication with said inlet port means, an annular exhaust groove therein adjacent to said bore in communication with said exhaust port, and control means for permitting or preventing fluid flow into said inlet port means.

3. The power tool of claim 2 wherein:

said inlet port means includes a forward inlet port and a reverse inlet port;

said handle means includes a forward inlet groove and a reverse inlet groove in communication with said forward and reverse inlet ports, respectively; and, said control means includes a selector valve for directing fluid flow into said forward inlet groove or into said reverse inlet groove.

4. The power tool of claim 3 and also including annular seal means located between said housing and handle means for preventing flow between said grooves except through said motor.

5. The power tool of claim 4 wherein said seal means comprises:

an annular seal member located between said exhaust groove and forward inlet groove;

an annular seal member located between said forward and reverse inlet grooves; and , an annular seal member located adjacent to said reverse inlet groove preventing flow from said groove to the atmosphere.

6. The tool of claim 5 and also including abutment means encircling said housing retaining said handle means on said housing in a position wherein said grooves in said handle means are in alignment with their respective ports in said housing, whereby appropriate fluid flow can occur from said handle means to said housing regardless of the rotative position of said handle means on said housing.

* * * * *